US007096651B2

(12) United States Patent
Hsieh

(10) Patent No.: US 7,096,651 B2
(45) Date of Patent: Aug. 29, 2006

(54) SYNCHRONOUSLY ADJUSTING DEVICE FOR THERMO SHRINKABLE FILM MACHINE

(76) Inventor: Tien-Sheng Hsieh, 11F-2, No. 43, Chai-I Street, Taichung City (TW)

( * ) Notice: Subject to any disclaimer, the term of this patent is extended or adjusted under 35 U.S.C. 154(b) by 316 days.

(21) Appl. No.: 10/833,985

(22) Filed: Apr. 28, 2004

(65) Prior Publication Data

US 2005/0241280 A1 Nov. 3, 2005

(51) Int. Cl.
*B65B 11/00* (2006.01)

(52) U.S. Cl. ..... 53/585; 493/302; 493/479; 493/475; 156/86

(58) Field of Classification Search ..... 53/585; 493/479
See application file for complete search history.

(56) References Cited

U.S. PATENT DOCUMENTS 1,915,976 A * 6/1933 Brodsky ..... 493/76
2,982,188 A * 5/1961 Von Hofe et al. ..... 493/6
4,765,121 A * 8/1988 Konstantin et al. ..... 53/442
5,120,297 A * 6/1992 Adami ..... 493/355
5,408,806 A * 4/1995 Lin et al. ..... 53/550
5,531,858 A * 7/1996 Hong ..... 156/556
6,070,399 A * 6/2000 Huang et al. ..... 53/585
7,028,452 B1 * 4/2006 Liao ..... 53/557

* cited by examiner

*Primary Examiner*—John Sipos
(74) *Attorney, Agent, or Firm*—Charles E. Baxley

(57) ABSTRACT

An adjusting device of a thermo shrinkable film machine includes first and second blocks movably mounted on two rails between two sideswalls on the base of the machine. Each of the two blocks has a wheel for contacting the film on a shaft. Two rotatable rods have two threaded sections of different directions of threads which rotatably extend through the two blocks respectively. The two respective ends of the two rotatable rods are connected to a rotating piece which is rotatably received in a case located between the first and second blocks. A driving wheel drives one of the rotatable rods so as to move the two blocks in opposite directions and to adjust the distance between the two wheels contacting the film of different thickness.

6 Claims, 6 Drawing Sheets

SYNCHRONOUSLY ADJUSTING DEVICE FOR THERMO SHRINKABLE FILM MACHINE

FIELD OF THE INVENTION

The present invention relates to an adjusting device for synchronously adjust two wheels contacting the thermo shrinkable film of different thickness.

BACKGROUND OF THE INVENTION

A conventional thermo shrinkable film machine generally includes a transmission wheel with a hole defined centrically therethrough and a shaft rotatably extends through the hole in the transmission wheel with a small gap defined between the inner periphery of the hole and the shaft. Two upper pressing wheels are located around the shaft so as to provide proper pressure on the thermo shrinkable film and to move film downward along the shaft. A cutting device is located beneath the transmission wheel so as to cut the film at pre-decided length. A positioning device is located beneath the transmission wheel and includes two lower pressing wheels which guide the film to be mounted to containers or cans. Two flexible plates are used to stop lower edge of the film which is not yet sent to mount on the containers or cans. A common problem is that the thickness of the film may vary due to the different manufacturers and the upper pressing and lower pressing wheels have to be adjusted accordingly by manual efforts and this spends a lot of time.

The present invention intends to provide an adjusting device which controls two wheels to contact the shrinkable film of different thickness synchronously.

SUMMARY OF THE INVENTION

The present invention relates to a thermo shrinkable film machine which comprises a base with first and second sidewalls and two rails are connected between the first and second sidewalls. A first block and a second block are movably mounted to the two rails. Each of the first and second blocks has a wheel which contacts a thermo shrinkable film on a shaft. A first rotatable rod rotatably extends through the first sidewall and has a first threaded section which threadedly extends through the first block. An end of the first rotatable rod is connected to an end of a rotating piece rotatably received in a case located between the first and second blocks. A second rotatable rod rotatably extends from the second sidewall and has a second threaded section which threadedly extends through the second block. An end of the second rotatable rod is connected to the other end of the rotating piece in the case. A driving wheel is located at an outside of the first sidewall and connected to the other end of the first rotatable rod such that the first and second blocks are moved in opposite directions when rotating the driving wheel.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
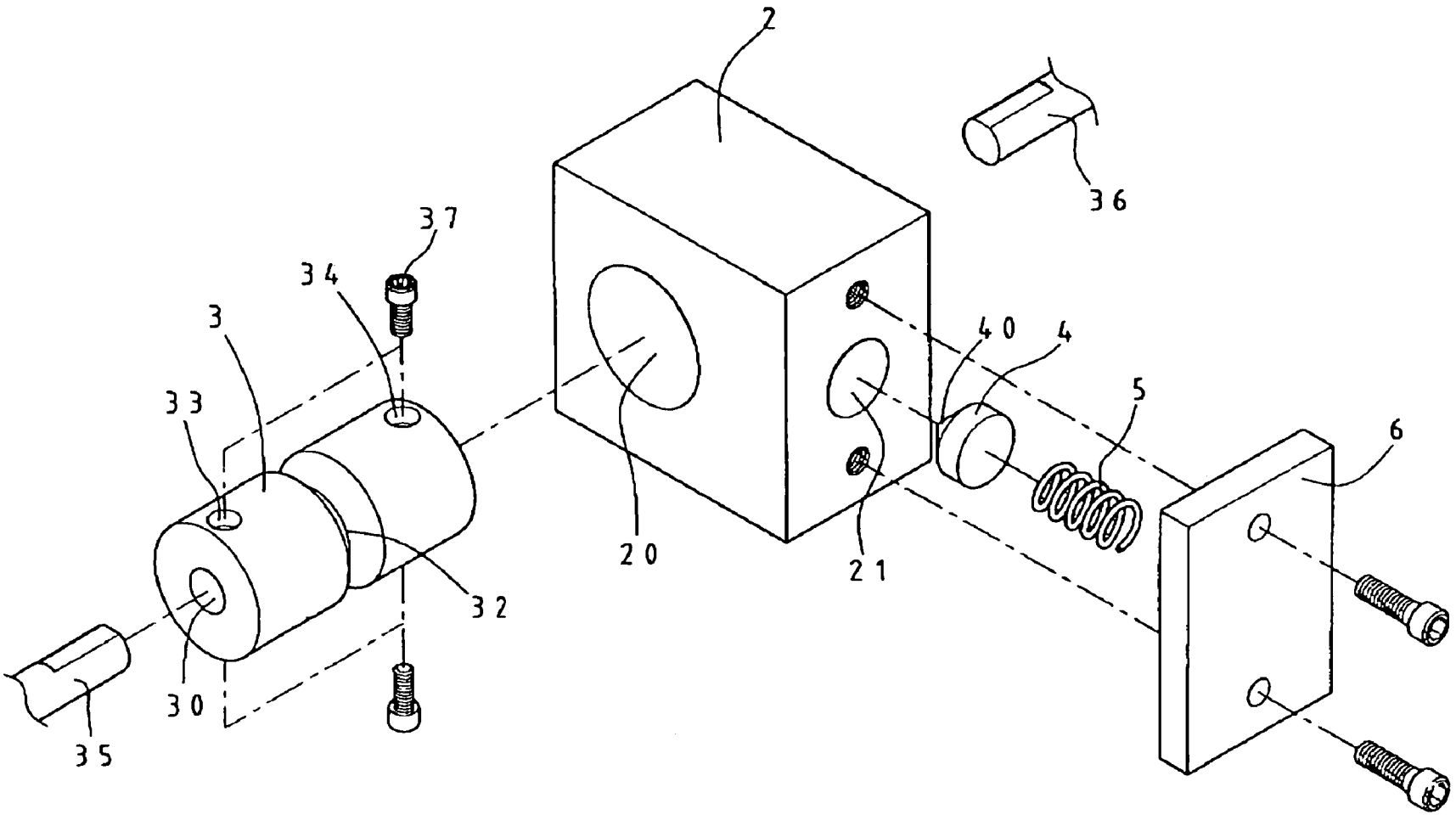
FIG. 1 is an exploded view to show the first and second rotatable rods, the rotating piece and the case of the adjusting device of the present invention.
Figure 2:
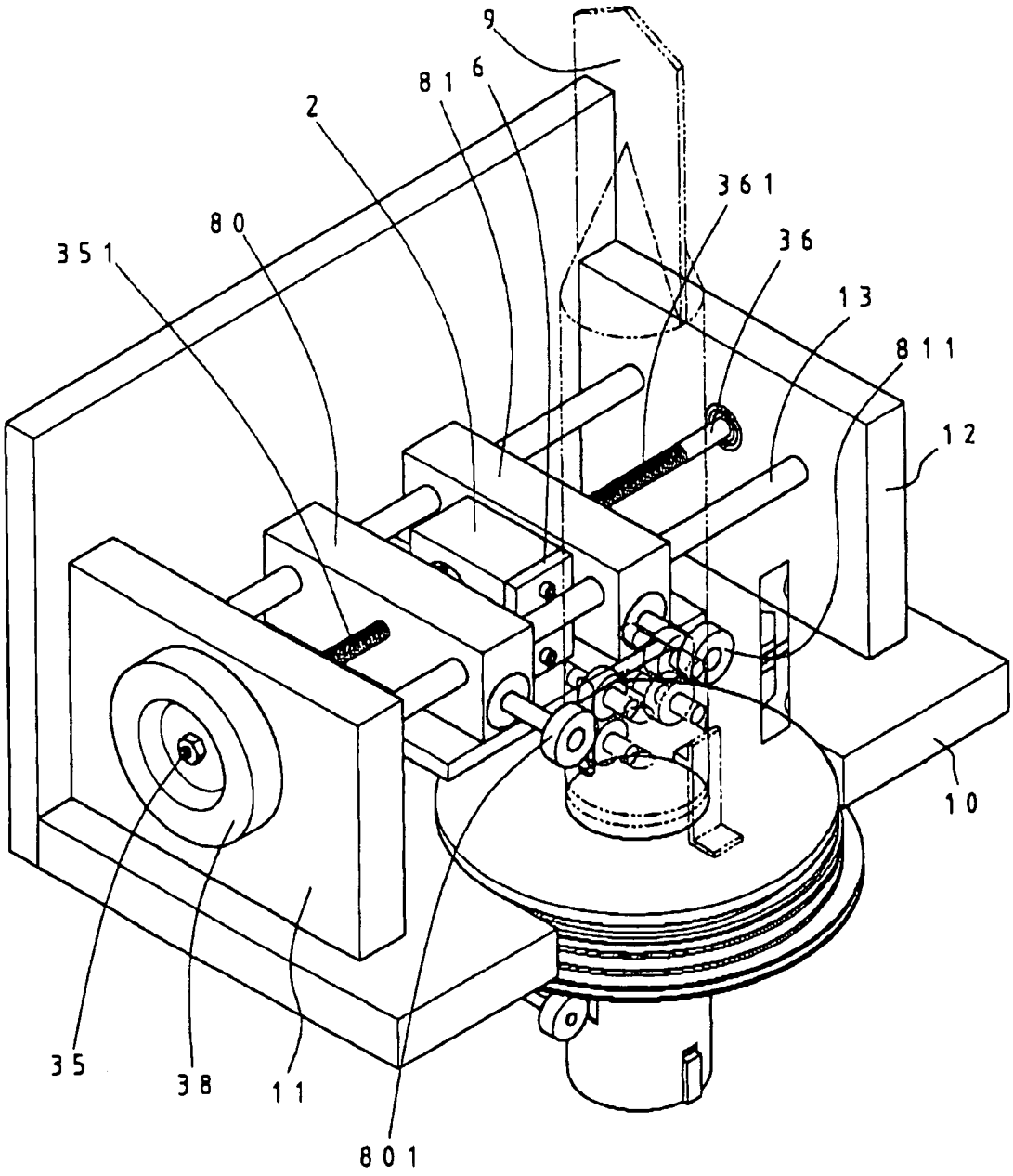
FIG. 2 is a perspective view to show the thermo shrinkable film machine and the adjusting device of the present invention.
Figure 3:
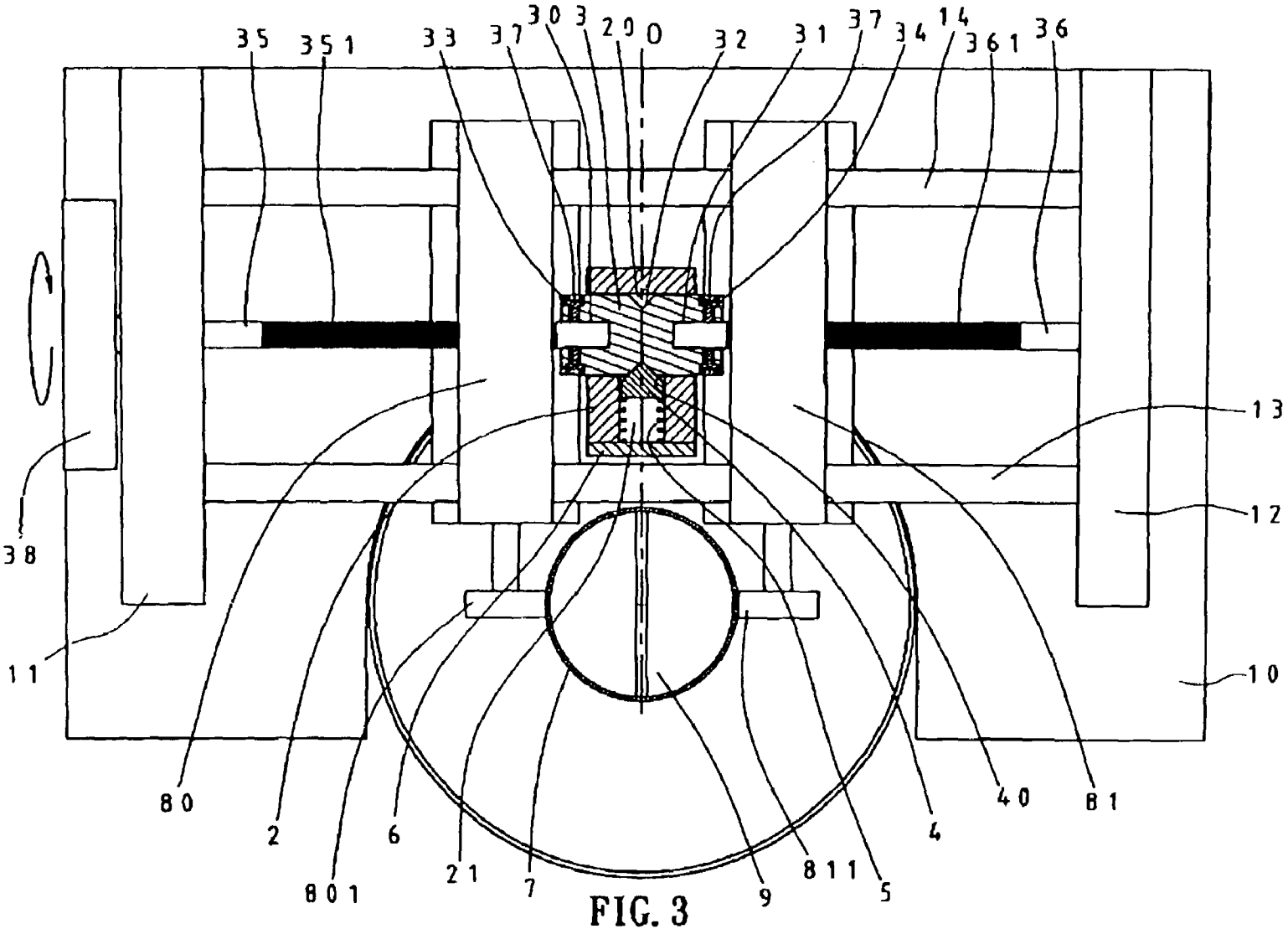
FIG. 3 is a cross sectional view to show that the two wheels on the two blocks is in contact with a thin film.

Referring to FIGS. 1 to 3, the thermo shrinkable film machine of the present invention comprises a base 10 and first and second sidewalls 11, 12 extend from a top of the base 10. A transmission wheel 60 for driving a shaft 9 is rotatably engaged with a recess in a side of the base 20. A thermo shrinkable film 7 are mounted to the shaft 9. Two rails 13, 14 are connected between the first and second sidewalls 11, 12 and a first block 80 and a second block 81 are movably mounted to the two rails 13, 14. Each of the first and second blocks 80, 81 has a wheel 801/811 and the shaft 89 is located between the two wheels 801, 811 so that the two wheels 801, 811 are in contact with the thermo shrinkable film on the shaft 9. A first rotatable rod 35 rotatably extends through the first sidewall 11 and has a first threaded section 351 which threadedly extends through the first block 80. A second rotatable rod 36 rotatably extends from the second sidewall 12 and has a second threaded section 361 which threadedly extends through the second block 81. The first threaded section 351 of the first rotatable rod 35 is a right-handed threaded section and the second threaded section 361 of the second rotatable rod 36 is a left-handed threaded section.

A rotating piece 3 is a cylindrical member and is rotatably received in a through hole 20 in a case 2 which is located between the two blocks 80, 81. Two recesses 30, 31 are defined in two ends of the rotating piece 3 so as to respectively receive two respective ends of the first and second rotatable rods 35, 36. The rotating piece 3 has two radial holes 33, 34 defined therein and communicating with recesses 30, 31. Two bolts 37 are threadedly engaged with the two radial holes 33, 34 to position the first and second rotatable rods 35, 36 in the rotating piece 3. The rotating piece 3 has a V-shaped groove 32 defined radially in an outer periphery thereof. The case 2 has a passage 21 which communicates with the through hole 20, a positioning member 4 biased by a spring 5 are received in the passage 21 and the spring 5 is biased between a cover 6 for closing the passage 21 and the positioning member 4. The positioning member 4 has a tip 40 which is engaged with the groove 32. The groove 32 is located on a plane O' which passes through a central axis of the shaft 9. This ensures that the two blocks 80, 81 are moved relative to the central axis of the shaft 9 when the first and second rotatable rods 35, 36 are rotated.

Figure 4:
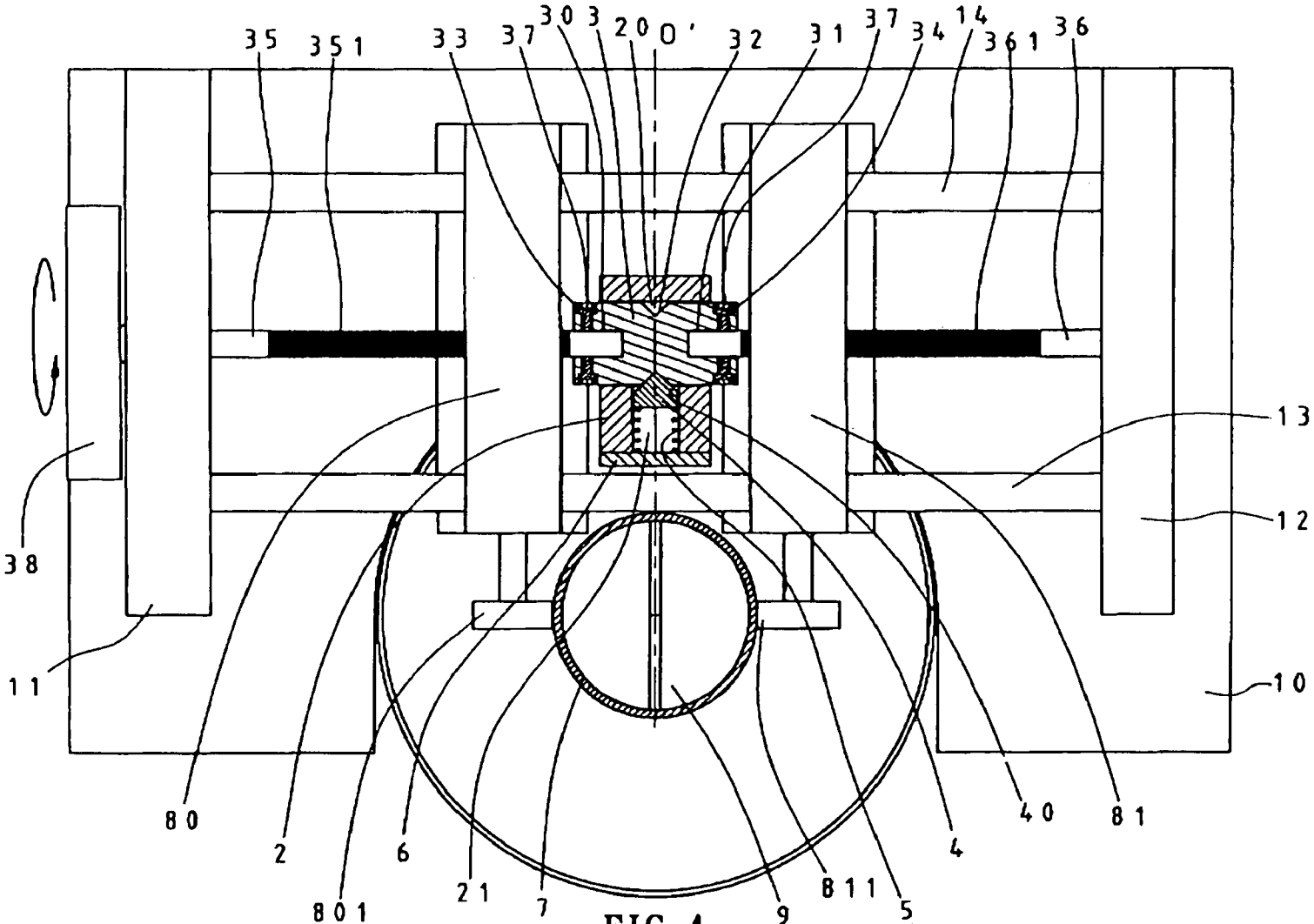
FIG. 4 is a cross sectional view to show that the two wheels on the two blocks is in contact with a think film.

A driving wheel 38 is located at an outside of the first sidewall 11 and connected to the other an end of the first rotatable rod 35 such that the first and second rotatable rods 35, 36 are rotated by rotating the driving wheel 38, and the first and second blocks 80, 81 are moved in opposite directions when rotating the driving wheel 38. By this way, as shown in FIG. 4, if the film 7 is thicker than the previous film 7, the two wheels 801, 811 are adjusted to be moved away from each other by rotating the driving wheel 38.

Figure 5:
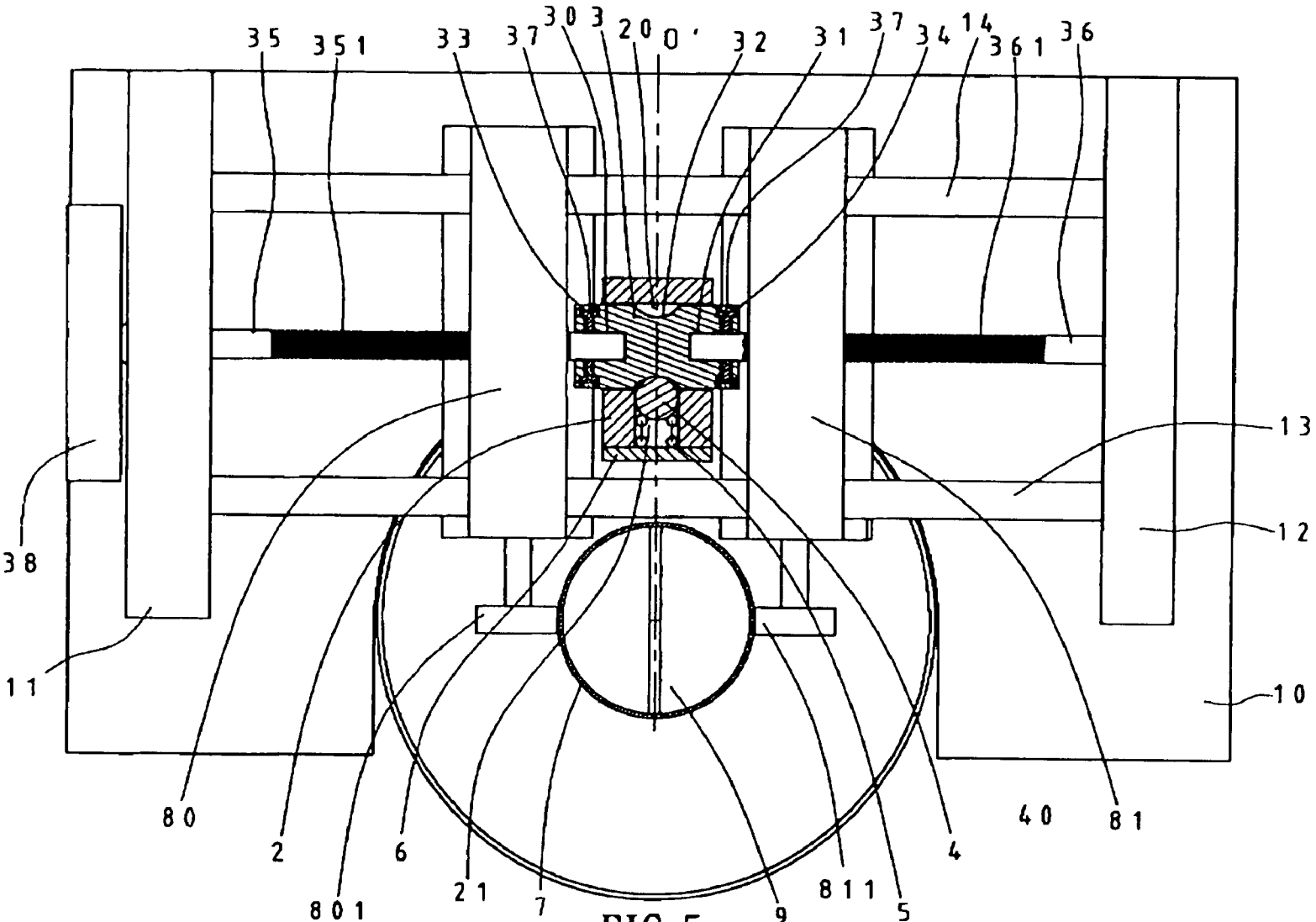
FIG. 5 shows another embodiment of the positioning member of the present invention.
Figure 6:
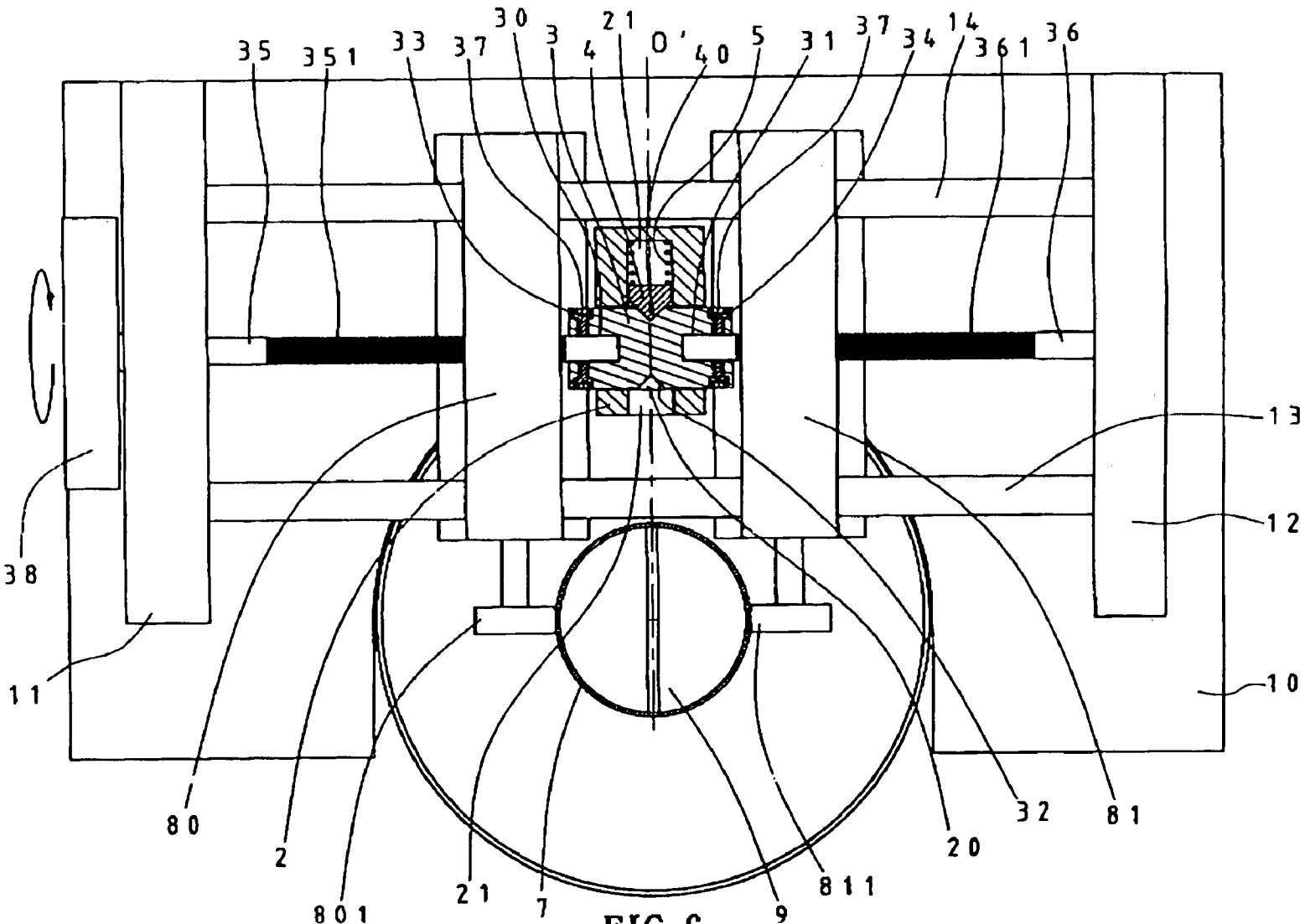
FIG. 6 shows yet another embodiment of the positioning member of the present invention.

FIG. 5 shows another embodiment of the present invention wherein the groove 32 has a semi-circular inner periphery and the positioning member 4 is a ball biased by the spring 5. The positioning member 4 is rotatably engaged with the groove 32. FIG. 6 shows that the case 2 is installed so that the rotating piece 3 is located between the positioning member 4 and the shaft 9.

While we have shown and described the embodiment in accordance with the present invention, it should be clear to those skilled in the art that further embodiments may be made without departing from the scope of the present invention.

What is claimed is:

1. A thermo shrinkable film machine comprising:

a base with first and second sidewalls on the base, two rails connected between the first and second sidewalls and a first block and a second block movably mounted to the two rails, each of the first and second blocks having a wheel which is adapted to contact a thermo shrinkable film on a shaft, a first rotatable rod rotatably extending through the first sidewall and having a first threaded section which threadedly extends through the first block, an end of the first rotatable rod connected to an end of a rotating piece rotatably received in a case located between the first and second blocks, a second rotatable rod rotatably extending from the second sidewall and having a second threaded section which threadedly extends through the second block, an end of the second rotatable rod connected to the other end of the rotating piece in the case, a driving wheel located at an outside of the first sidewall and connected to the other end of the first rotatable rod such that the first and second blocks are moved in opposite directions when rotating the driving wheel, wherein the rotating piece is a cylindrical member and has a groove defined radially in an outer periphery thereof, the case having a positioning member which is biased by a spring, the positioning member having a tip engaged with the groove.

2. The machine as claimed in claim 1, wherein the groove is located on a plane which is adapted to pass through a central axis of the shaft.

3. The machine as claimed in claim 1, wherein the first threaded section of the first rotatable rod is a right-handed threaded section and the second threaded section of the second rotatable rod is a left-handed threaded section.

4. The machine as claimed in claim 1, wherein the rotating piece has two recesses defined in two ends thereof so as to receive the first and second rotatable rods respectively.

5. The machine as claimed in claim 4, wherein the rotating piece has two radial holes defined therein and communicating with recesses, two bolts threadedly engaged with the two radial holes to position the first and second rotatable rods in the rotating piece.

6. The machine as claimed in claim 1, wherein the rotating piece is a cylindrical member and has a groove defined radially in an outer periphery thereof, the groove having a semi-circular inner periphery, the case having a positioning member which is a ball and biased by a spring, the positioning member rotatably engaged with the groove.

* * * * *